United States Patent [19]

Faires, Jr.

[11] 4,173,930

[45] Nov. 13, 1979

[54] DIMPLED SHOTGUN PELLETS

[76] Inventor: C. Dickson Faires, Jr., 7621 Somerset Bay, Apt. B, Indianapolis, Ind. 46240

[21] Appl. No.: 844,880

[22] Filed: Oct. 25, 1977

[51] Int. Cl.[2] ..... F42B 7/02

[52] U.S. Cl. ..... 102/42 R; 102/42 C; 102/92.1

[58] Field of Search ..... 102/42 R, 42 C, 92.1

[56] References Cited

U.S. PATENT DOCUMENTS 3,952,659 4/1976 Sistino ..... 102/92.1

FOREIGN PATENT DOCUMENTS 1108080 8/1955 France ..... 102/42 R

*Primary Examiner*—Verlin R. Pendegrass

[57] ABSTRACT

Dimpled shotgun pellets for use in a standard shotshell load (hunting or target; factory load or reloaded) in which the pellets are generally spherical in configuration with a plurality of concave dimples arranged on the outer surfaces thereof. The dimples may be arranged either symmetrically or asymmetrically on the outer pellet surfaces and result in an improvement in the aerodynamics of the individual dimpled pellets once they have left the muzzle of the shotgun.

8 Claims, 3 Drawing Figures

DIMPLED SHOTGUN PELLETS

BACKGROUND OF THE INVENTION

1. Field of the Invention

This invention relates to the field of shotshell loads and particularly to an improved shot configuration having a plurality of concave dimples arranged on the outer surfaces of the shot.

2. Description of the Prior Art

The shotshell load or charge for any conventional gauge of shotgun, ranging from 410 ga. up to 10 ga., characteristically includes a casing having a brass portion and a plastic or paper portion, a primer seated in the closed end of the brass portion, a powder charge laid inside the brass portion, a wad structure seating the powder charge in the casing and a number of pellets or shot, resting on top of the wad structure and filling the inner column in the plastic or paper housing portion of the casing. The open distal end of such housing portion is then crimped, or closed, against the shot thereby preventing the shot from spilling out of the housing before the powder charge is exploded.

In this conventional shotshell arrangement, spherical pellets are the standard and accepted type of shot employed. Through the years, lead has been universally employed to fabricate such spherical shot because of its very high density and the ease with which the spheres can be very inexpensively fabricated. In recent years, however, various ecological and environmental considerations, such as the problem of lead-poisoning in waterfowl, have directed research and development into the possibility of replacing lead as the preferred material, with steel, or iron, as the prime candidate. Although many sportsmen, and particularly hunters, have strongly protested any such replacement, mainly because of the much lighter density of such other materials and the corresponding decrease in effective killing distance which this suggests, the strength of the various ecological and environmental bodies is such that it is anticipated that lead shot may soon be a thing of the past. Other arguments voiced against the possible changeover to steel shot involve the possibility of barrel damage resulting from the harder steel pellets and the crippling losses and accuracy problems occasioned by the more rapidly decelerating steel pellets.

Variations in the generally spherical configuration of shotshell pellets have been proposed over the years, and particularly in recent times possibly in light of the proposed change to the much lighter steel, or iron, material. As discussed in U.S. Pat. No. 3,952,659, shotshells utilizing a mixture of both spherical and flat discs were apparently disclosed in U.S. Pat. No. 1,583,559, with such configurations not providing any great improvement in packing density or aerodynamic characteristics over the conventional spherical configuration. A cubical pellet configuration was apparently first disclosed in U.S. Pat. No. 487,028 with little success, and pellets in the form of cylinders were disclosed in U.S. Pat. No. 2,343,818. With the major stress being to maximize force to shot communication, U.S. Pat. No. 3,264,996 issued to Rimar discloses a stacking means for holding the buckshot or spheroidal projectiles within a shotgun shell in a plurality of separate upright columns so as to allow the full setback force of the discharge to be communicated to each individual projectile in a straight line, and to conduct the projectiles in the columnar arrangement through the barrel of the shotgun and protect them from being deformed through friction during their passage therethrough.

Stressing the importance of packing density, U.S. Pat. No. 3,952,659 issued to Sistino provides generally spherical shot pellets which have six equally spaced, substantially flat bases which are separated from each other by spherical portions. As expressly stated therein, the six-sided, flattened spherical shot "has the desirable property of flying with substantially the same flight characteristic and penetration as spherical shot" while also providing a greater packing density than is conventionally obtainable. Sistino also discloses, at col. 1, lines 36–39, three other prior art references which teach the use of pellets formed in the shape of cylinders, cubes and discs to increase packing density or alter the shop pattern.

In U.S. Pat. No. 3,877,381, issued to McCoy, pellets are disclosed having a tapered cavity in one end and a tapered outer portion at the other end, whereby the tapered portion of one pellet is insertable in the cavity of the adjacent pellet. In this manner, McCoy also achieves a greater packing density and strives for good aerodynamic characteristics by providing a plurality of stacks of nesting pellets seated in the shotgun shells.

In U.S. Pat. No. 3,667,390, issued to Medin, another variation from the conventional spherical configuration is disclosed therein for fragmentary elements used in various explosive weapons. Specifically, each fragmentary element comprises a member having the general shape of a sphere with six flat surfaces located along the greatest diameter of the sphere at its equitorial zone thereby giving a regular hexagonal shape when sectioned with a plane through the greatest diameter and the center of the sphere.

As is evidenced by the above prior art references, much work has been done with regard to stacking the various pellet configurations and achieving the greatest packing densities. However, little research or regard has been given to developing new pellet configurations which achieve an improvement in the aerodynamics of the pellets by minimizing wind resistance and thus maintaining more of their initial muzzle velocity throughout their flight. As expressly shown in Sistino, research has been merely delegated to maintaining substantially the same flight characteristics and penetration as with conventional spherical shot.

SUMMARY OF THE INVENTION

One embodiment of the present invention comprises a shotshell load including a casing, a primer, a powder charge, a wad structure and a plurality of pellets, the improvement comprising the pellets having a plurality of concave dimples arranged on the outer surfaces thereof.

In one mode of practicing the above embodiment, about at least 25 concave dimples are symmetrically arranged on the outer surface of each generally spherical pellet.

One object of the present invention is to provide an improved pellet configuration which achieves a decrease in the rate of deceleration of the pellets. Stated differently, velocity of the dimpled pellets is greater at all distances from the gun muzzle in comparison to standard pellets.

Another object of the present invention is to provide an improved pellet configuration which achieves less "drop" during the flight of the dimpled pellets, as that term is understood by those having knowledge of the art and science of ballistics.

Another object of the present invention is to provide an improved pellet configuration which achieves better shot patterns in terms of symmetrical distribution of the pellets and percent of pellets maintained within the standard thirty (30) inch pattern test circle at various distances.

The above objectives and advantages of the present invention are accomplished by changing the configuration of the standard pellets so that the aerodynamics of the individual dimpled pellets are improved once they have left one muzzle of the shotgun.

Related objects and advantages of the present invention will be apparent from the following description.

DESCRIPTION OF THE PREFERRED EMBODIMENT

Figure 1:
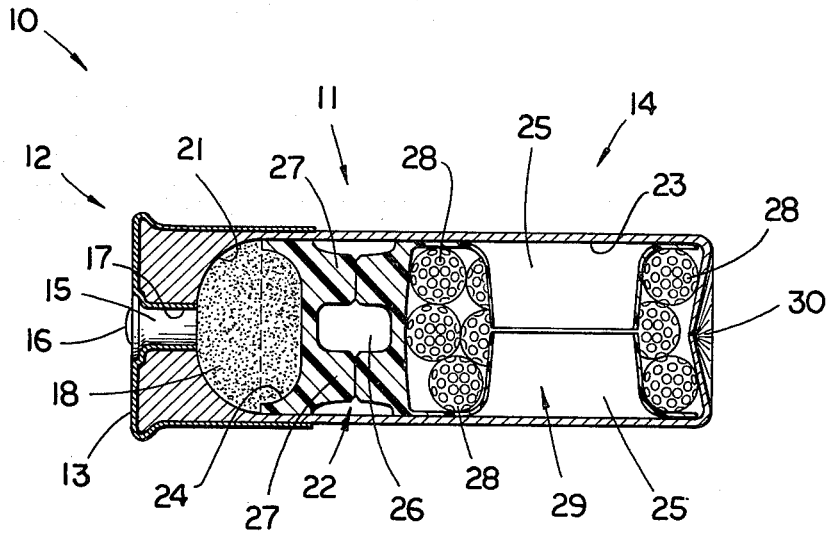
FIG. 1 is a side view with portions cut away of a shotshell load including the dimpled shotgun pellets comprising the preferred embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, a shotshell load or charge 10 including dimpled pellets in accordance with the preferred embodiment of the present invention is therein depicted. It includes a casing 11 composed of a base portion 12, consisting at least in part of a brass outer casing 13, and a tubular plastic or paper portion 14 integrally connected therewith. A percussion primer 15 including an inner explosive charge and a striking surface 16 is removably seated in an appropriately sized opening 17 in the base portion 12. A powder charge 18, which may vary substantially according to the "hotness" or "lightness" of the desired load, is seated inside casing 11 and compressed against inner wall 21 in base portion 12 by means of a wad structure 22.

Originally, the wadding 22 for shotshell loads was composed of one or more coin-shaped pads of varying thicknesses which were placed inside the columnar cavity 23 in casing 11 and were tamped down against the powder charge 18 thereby compressing it against wall 21. Such wads were generally of a compressed paper material, although various other materials have been employed. In recent years, these paper wads have been replaced by varying designs and shapes of one-piece plastic wad structures which function equally well or better and are much more easily handled and cheaper to produce than the more conventional structures.

In the preferred embodiment 10 of the present invention, wad 22 is such a multiple purpose wad structure having a partially cupped end 24 to compress the powder charge 18, a shot cup 29 composed of four individual flaps 25, and a central open portion 26 having four creased bridges or supports 27 which collapse inwardly upon the firing of the shotshell load.

A plurality of dimpled shotshell pellets, or shot, 28 manufactured in accordance with the preferred embodiment of the present invention are randomly packed in the columnar cavity 23 in casing 11 inside the shot cup 29 of the wad 22. Such shotshell pellets may vary greatly in size depending upon the particular animal, sport, target, game, or purpose, for which the load is to be used. Specifically, such shot ranges from a No. 12 shot which is 0.05 inches in diameter to a No. 00 shot which is 0.33 inches in diameter. As previously stated, although lead is presently the standard material from which such shot is fabricated, other materials such as steel, or iron, are slowly being introduced into the market and may one day replace lead as the standard shot material. In the preferred embodment, however, shotshell 10 is a 12 ga. load and pellets 28 are No. 00 lead buckshot, as may be used in the hunting of deer in such states that prohibit the use of high-powered rifles. Although the number of pellets 28 randomly packed in the shot cup 29 may also vary, shotshell 10 of the preferred embodiment contains 12 such dimpled pellets.

The tubular end 30 of shotshell 10 is then crimped, or closed, tightly against the pellets 28. In this manner, the pellets can not spill out of the shotshell until the powder charge 18 is exploded by striking primer 15.

Figure 2:
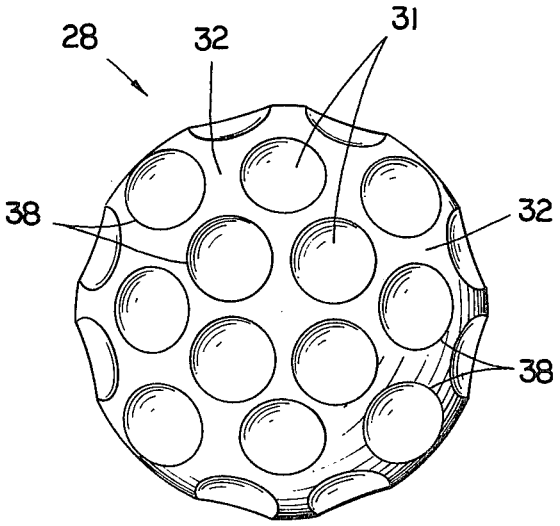
FIG. 2 is an enlarged perspective view of a dimpled shotgun pellet in accordance with the preferred embodiment in FIG. 1.
Figure 3:
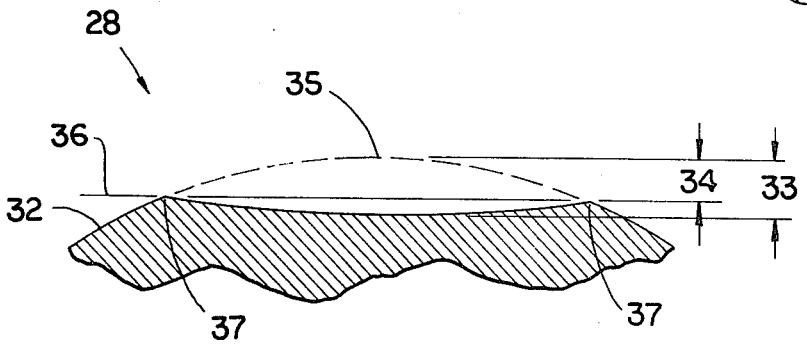
FIG. 3 is an enlarged cross-sectional view of a single dimple or cavity on the dimpled shotgun pellet in FIG. 2.

Referring now to FIGS. 2 and 3, each pellet 28 includes a number of concave dimples 31 arranged around the outer surface 32 of the shot. Each pellet 28 of the preferred embodiment includes about at least 40 circular dimples or cavities arranged symmetrically around the outer surface 32. In this regard, the exact number of dimples on each shot and the size, depth and shape of each dimple or cavity 31 may vary substantially according to the size of shot used and the particular method of fabrication. However, testing to date suggests the number of such dimples on each shot should be relatively high, i.e., in the range of about 25 or more, in order to obtain the beneficial results taught by the present invention.

In addition, the arrangement of such dimples on the outer surface 32 need not be symmetric but may, in fact, be asymmetric so long as a significant and major portion of the outer shot surface 32 exhibits the dimpled pattern. Therefore, any such variations in the number, configuration, size and arrangement of dimples or cavities 31 on the pellet surfaces are clearly within the contemplation of the present invention and the scope of the claims attached hereto.

The major other concern, or factor to be considered, with fabricating the dimpled pellets or shot in accordance with the present invention is to make sure that the depth of each cavity or dimple, designated 33 in FIG. 3, is not insignificantly greater than the distance 34 in FIG. 3 designating the distance from the outermost point 35 on the phantom sphere surface to a line 36 connecting the diametrically opposed points 37 on the circle 38 formed where the cavity 31 contacts the outer shot surface 32. This difference between the depth 33 and distance 34 represents the degree or amount of concavity for a given dimple 31 and by "not insignificantly greater than," it is meant that the ratio of such depth 33 to distance 34 should be about at least 1.34:1. Although ratios substantially greater than this may be successfully used in accordance with the present invention, initial testing suggests that pellets having ratios less than about 1.34:1 fail to exhibit the full improved accuracy and truer flight pattern characteristic of the present invention. It is also not required that the amount or ratio of concavity be the same for each dimple 31 on a given pellet 28. In this regard, the sole requirement is that each dimple exhibit about at least the desired ratio of depth to distance. In the preferred embodiment, this minimum-suggested ratio of 1.34:1 was observed for each dimple 31 on the several pellets 28 in the shotshell load.

For the remainder of this specification, and the claims attached hereto, the term "ratio of concavity" shall be used to represent the degree or amount of concavity for a given dimple or group of dimples on a shotgun pellet, and is determined by the ratio of this depth 33 to distance 34 defined above.

In practice, shotshell loads containing dimpled shotshell pellets fabricated in accordance with the principles of the present invention produce improved accuracy and tighter shot groupings or patterns. During test comparisons over varying distances using identical loads containing the same number of shot per shell, the loads containing pellets fabricated in accordance with the preferred embodiment of the present invention out-performed the loads equipped with standard spherical No. 00 lead shot when judged for the total number of shot in the target, the uppermost shot below the bullseye, the bottommost shot below the bullseye and the widest shot spread. In addition, the standard spherical shot loads consistently produced relatively low shot patterns whereas the special dimpled loads produced good, relatively high groupings with only a few erratic pellets.

Although the exact theory or reason for the improved results using applicant's special dimpled shotshell loads is unknown, such tests strongly suggest, and thereby support applicant's belief that, pellets fabricated in accordance with the principles of the present invention better maintain their initial muzzle velocity throughout their flight to the target and are more aerodynamically stable following a truer flight pattern than conventional spherically-configured shot. It is also believed that the dimpled configuration of such improved shot minimizes wind resistance and is less affected by wind currents during flight.

Methods of fabricating dimpled shotshell pellets in accordance with the principles of the present invention are many and varied. Specifically, it will most probably be possible to convert existing and conventional stamping and other various methods and apparata to the manufacture of dimpled shot in accordance with the present invention by merely replacing the various dyes and other tooling apparatus presently used with ones equipped to stamp and produce shot having various symmetric or asymmetric dimple, or cavity, patterns on their outer surfaces. In addition, through the intergranular inclusion of salts, such as sodium chloride or lead chloride, or various other deposits, such as graphite or sulfur in steel making operations, during initial formation, it may be later possible to chemically or physically remove such deposits near the surface thereby producing a random and asymmetric dimple, or cavity, pattern consistent with the principles of the present invention as herein disclosed. As used herein, the term "concave" need not require a curved surface on the dimple but rather any depressed area which accomplishes a similar result is to be encompassed by the term "concave."

Regardless of the exact method chosen, however, fabrication and use of dimpled shotshell pellets in accordance with the present invention will result in improved accuracy and tighter shot groupings. This in turn will greatly aid in hunting, no matter what the desired game, or in whatever shotshell sport, such as skeet or trap, an individual may be involved.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A shotshell load including a casing, a primer, a powder charge, a wad and a plurality of pellets, the improvement comprising said pellets having a plurality of concave dimples arranged on the outer surfaces thereof, the concave dimples being arranged symmetrically around the outer surfaces of said pellets.

2. A shotshell load including a casing, a primer, a powder charge, a wad and a plurality of pellets, the improvement comprising said pellets having a plurality of concave dimples arranged on the outer surfaces thereof, about at least 25 concave dimples being arranged on the outer surface of each of said pellets.

3. A shotshell load including a casing, a primer, a powder charge, a wad and a plurality of pellets, the improvement comprising said pellets having a plurality of concave dimples arranged on the outer surfaces thereof, the ratio of concavity for each of the concave dimples on the outer surfaces of said pellets being about at least 1.34:1.

4. The shotshell load in claim 3 in which about at least 25 concave dimples are arranged on the outer surface of each of said pellets.

5. A shotshell load consisting essentially of a casing, a primer, a powder charge, a wad and a plurality of pellets, the improvement comprising said pellets having a plurality of concave dimples arranged on the outer surfaces thereof.

6. The shotshell load in claim 5 in which about at least 25 concave dimples are arranged on the outer surface of each of said pellets.

7. The shotshell load in claim 6 in which the concave dimples are arranged symmetrically around the outer surfaces of said pellets.

8. The shotshell load in claim 6 in which the ratio of concavity for each of the concave dimples on the outer surfaces of said pellets is about at least 1.34:1.

* * * * *